US009350077B1

(12) United States Patent
Zheng et al.

(10) Patent No.: US 9,350,077 B1
(45) Date of Patent: May 24, 2016

(54) LOW SAR FOLDED LOOP-SHAPED ANTENNA

(71) Applicant: Amazon Technologies, Inc., Reno, NV (US)

(72) Inventors: Ming Zheng, Cupertino, CA (US); Joseph Christopher Modro, Palo Alto, CA (US)

(73) Assignee: Amazon Technologies, Inc., Reno, NV (US)

( * ) Notice: Subject to any disclaimer, the term of this patent is extended or adjusted under 35 U.S.C. 154(b) by 279 days.

(21) Appl. No.: 13/961,985

(22) Filed: Aug. 8, 2013

(51) Int. Cl.
*H01Q 7/00* (2006.01)
*H01Q 1/24* (2006.01)
*H01Q 5/00* (2015.01)

(52) U.S. Cl.
CPC ..... *H01Q 7/00* (2013.01); *H01Q 5/0027* (2013.01)

(58) Field of Classification Search
CPC ..... H01Q 7/00; H01Q 1/243
USPC ..... 343/866, 702
See application file for complete search history.

(56) References Cited

U.S. PATENT DOCUMENTS

| | | | | |
|---|---|---|---|---|
| 7,215,293 | B2 * | 5/2007 | Chen et al. | 343/741 |
| 7,342,539 | B2 * | 3/2008 | Rosenberg | H01Q 1/243 343/702 |
| 7,768,466 | B2 * | 8/2010 | Chi | H01Q 7/00 343/700 MS |
| 2012/0274530 | A1 * | 11/2012 | Minemura et al. | 343/793 |
| 2013/0201074 | A1 * | 8/2013 | Harper | H01Q 1/38 343/870 |
| 2015/0022402 | A1 * | 1/2015 | Gavilan et al. | 343/702 |

* cited by examiner

*Primary Examiner* — Hoang V Nguyen
(74) *Attorney, Agent, or Firm* — Seyfarth Shaw LLP; Ilan N. Barzilay; David A. Klein

(57) ABSTRACT

A low Specific Absorption Rate (SAR) gamma-folded loop-shaped antenna has a resonant structure including two arms connected to an elongated loop and has dual resonant elements in the 5 GHz WiFi band, dividing emissions in the 5 GHz bands between two emission hotspots. The elongated loop folds back upon itself 180 degrees. The antenna also may include a discontinuous transition in cross-sectional area tuned to boost emissions in the 2.4 GHz WiFi band. The antenna is designed for compact handheld devices that may be held close to a person's body, reducing the intensity of energy irradiated into the body in the 5 GHz band by distributing the energy across spatially-separated dual resonant elements.

15 Claims, 15 Drawing Sheets

LOW SAR FOLDED LOOP-SHAPED ANTENNA

BACKGROUND

The increasing use of wireless communication links between a large variety of devices has led to numerous advancements in antenna design. Mobile devices such as cellular telephones communicate wirelessly in a number of different frequency bands that are specified in various industry standards. A variety of antenna designs are incorporated in wireless devices such as cellular telephones to facilitate communication on one or more appropriate frequency bands, in accordance with the standards. Mobile devices may include multiband antenna configurations that facilitate communication on more than one frequency band. However, it has been challenging to design multiband antennas that provide acceptable performance in space-constrained applications such as mobile phones and other mobile communication devices.

BRIEF DESCRIPTION OF DRAWINGS

For a more complete understanding of the present disclosure, reference is now made to the following description taken in conjunction with the accompanying drawings.

DETAILED DESCRIPTION

Figure 1A:
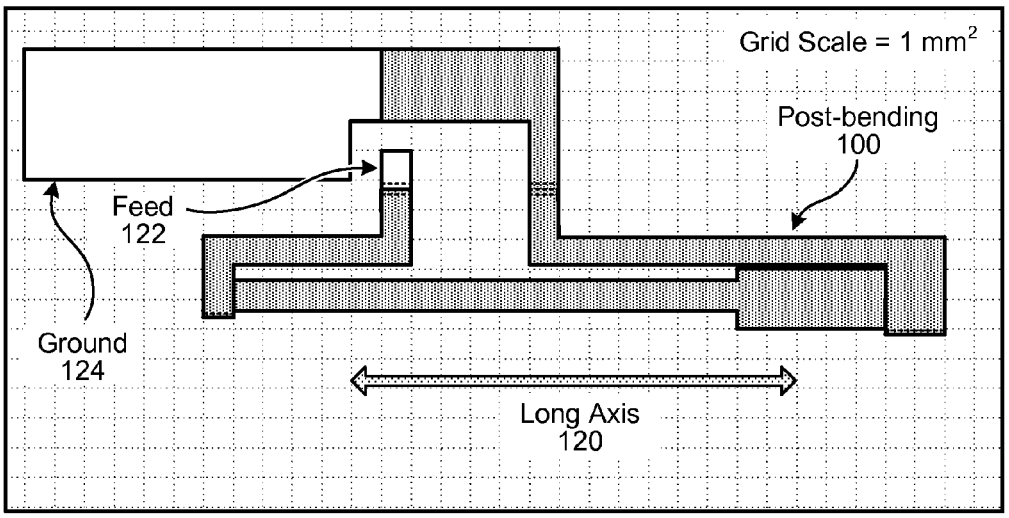
FIGS. 1A to 1B illustrate a scale view of the folded loop-shaped antenna after and before bending.

A folded loop-shaped antenna 100 for mobile devices, as illustrated in FIG. 1A, has dual resonant elements within a frequency band. The dual resonant elements are spatially separated toward opposite ends of the antenna. At an equivalent overall transmission power, each resonant element of the antenna 100 generates a less intense energy emission "hotspot" than that produced by the single resonant element of conventional designs. As energy emissions are government regulated, the distributed emission pattern more easily accommodates stricter regulations, as well as enabling the use of higher power levels within an existing regulatory framework. Multiband features may be integrated directly into the loop, so that the same structures may contribute to resonance in more than one frequency band.

Specific Absorption Rate (SAR) is a measure of the rate with which RF (radio frequency) energy is absorbed by the human body. SAR provides a means for measuring the RF exposure characteristics of cellular telephones and other wireless devices to ensure that they are within the safety guidelines set by regulatory agencies, such as the Federal Communications Commission (FCC) in the United States of America. The SAR values are intended to ensure that a cellular telephone or wireless device does not exceed the a maximum permissible exposure level even when operating in conditions which result in the device's highest possible (but not its typical) RF energy absorption for a user.

SAR testing uses standardized models of the human head and body that are filled with liquids that simulate the RF absorption characteristics of different human tissues. In order to determine regulatory compliance, each cellular telephone is tested while operating at its highest power level in all the frequency bands in which it operates, and in various specific positions against a dummy head and body, to simulate the way different users typically hold a cellular telephone, including to each side of the head. To test cellular telephones for SAR compliance, the telephone is precisely placed in various common positions next to the head and body, and a robotic probe takes a series of measurements of the electric field at specific pinpoint locations in a very precise, grid-like pattern within the dummy head and torso. In the United States, the FCC uses the highest SAR value for each frequency band to demonstrate compliance with the FCC's RF guidelines.

Adopted in 1996, current FCC guidelines (circa 2013) require cellular telephone manufacturers to ensure that the maximum exposure is at or below a SAR level of 1.6 watts per kilogram (1.6 W/kg) with a 1 gram mass. However, on Mar. 27, 2013, the FCC opened an "Inquiry" to determine whether the existing SAR standards continue to be adequate. If the FCC adopts stricter standards, cellular telephone manufacturers may have to reduce the transmission power of their devices, diminishing the devices' operational range.

Cellular telephones and other handheld wireless devices commonly use Inverted-F Antennas (IFA) and monopole antennas. Increasingly, cellular telephones use Planar Inverted F Antennas (PIFA). A PIFA is resonant at a quarter-wavelength, reducing the space required for the antenna within the telephone. Compared to earlier designs, PIFAs generally have improved SAR properties. A PIFA resembles an inverted F, which explains the PIFA name, and can be designed to have multiple branches that resonate at different radio frequencies. While PIFA antennas generally have better SAR properties than their predecessors, at any one of the resonant frequencies, their design nonetheless results in highly a localized current concentration, producing an intense SAR hotspot.

Figure 18:
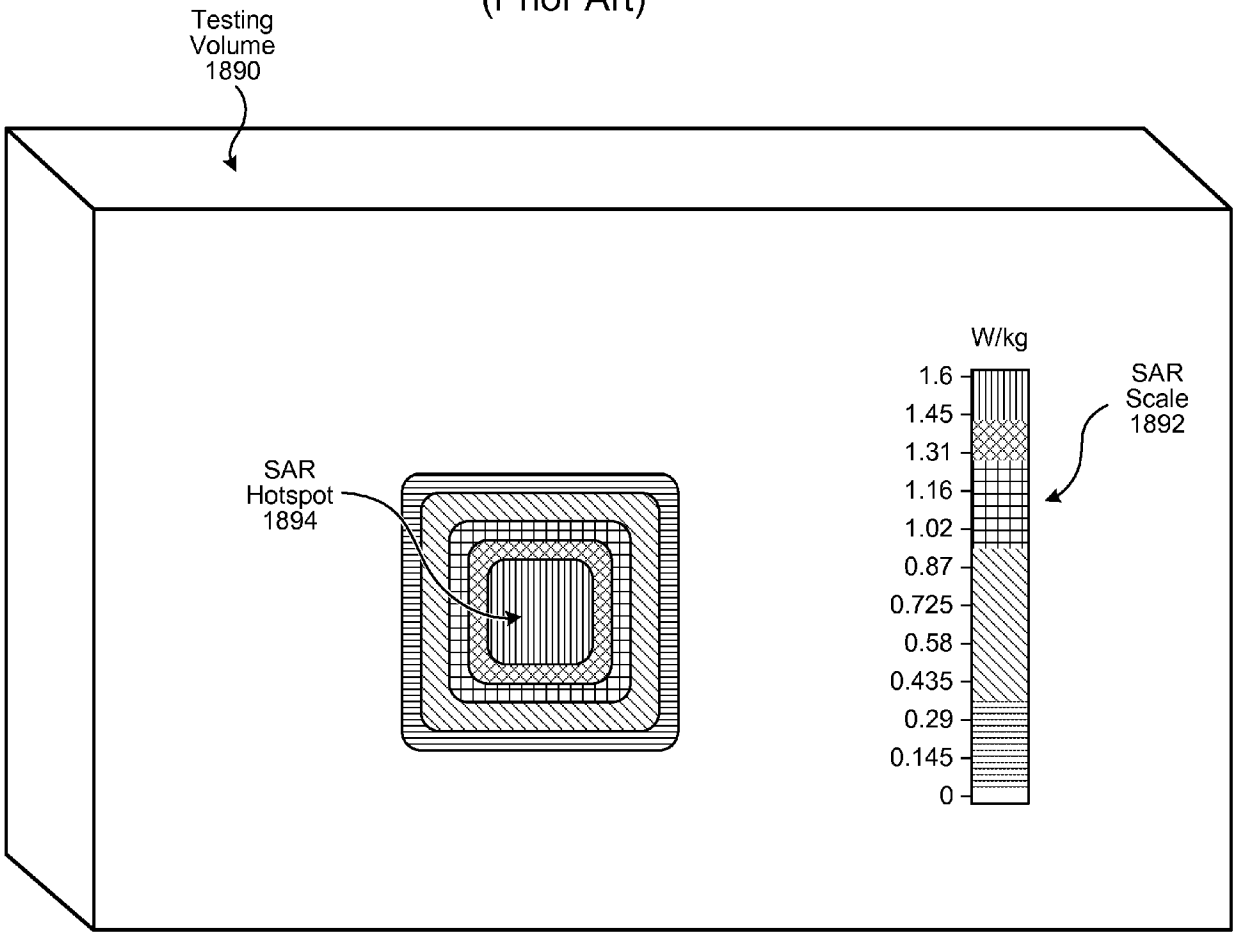
FIG. 18 (Prior Art)
FIG. 18 illustrates the single hotspot generated by a conventional Planar Inverted F Antenna (PIFA).

FIG. 18 illustrates a SAR testing volume 1890 used to simulate a human head. The testing volume 1890 shows the SAR hotspot 1894 resulting from the testing of a device utilizing a PIFA at a resonant frequency of 5.6 GHz. The SAR hotspot 1894 is highly localized. At the power level tested, the hotspot emissions approach the FCC limit of 1.6 W/kg, as shown on the scale 1892. The 5 GHz band is used by Wireless Local Area Network (WLAN) standards such as IEEE 802.11n and 802.11ac WiFi and extends from 5.1 to 5.85 GHz, subdivided into multiple channels. The tested frequency of 5.6 GHz corresponds to a channel close to the middle of the 5 GHz band.

The 5 GHz band has presented particular challenges for mobile device designers compared to the 2.4 GHz spectrum used by the earlier WLAN standards such as IEEE 802.11b and 802.11g (also supported by 802.11n, and extending from 2.40 to 2.48 GHz). With the 2.4 GHz band heavily used to the point of being crowded, shifting communications to the relatively unused 5 GHz band provides significant advantages. However, for a same amount of power, the higher carrier frequency comes with the disadvantage of a shorter range. Compared to the 2.4 GHz band, 5 GHz band signals are absorbed more readily by walls and other solid objects in their path and, as a result, cannot penetrate as far. Thus, in order to achieve a range similar to that of a 2.4 GHz radio at close to a respective WiFi standard's maximum data rate, a 5 GHz radio may require significantly more power, producing stronger emissions and a more intense SAR hotspot. This, among other reasons, has contributed to many cellular telephones only supporting 802.11n in the 2.4 GHz band.

Also, when conventional multiband designs place a high band antenna (e.g., 5 GHz) and a low band antenna (e.g., 2.4 GHz) in close proximity, mutual electromagnetic coupling may occur between the antennas. Low band antennas which are designed to operate in a predetermined low frequency band can also resonate at harmonic frequencies above the low frequency band. The harmonic resonation of the low band antenna in the operating band of the nearby high band antenna detrimentally affects performance of both the high band antenna and the low band antenna, substantially reducing efficiency.

Figure 1B:
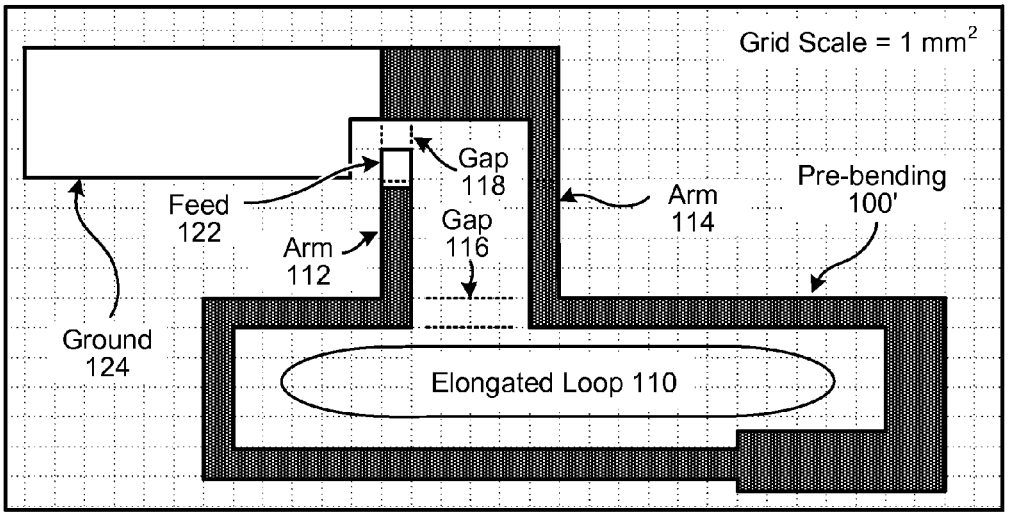
Figure 2A:
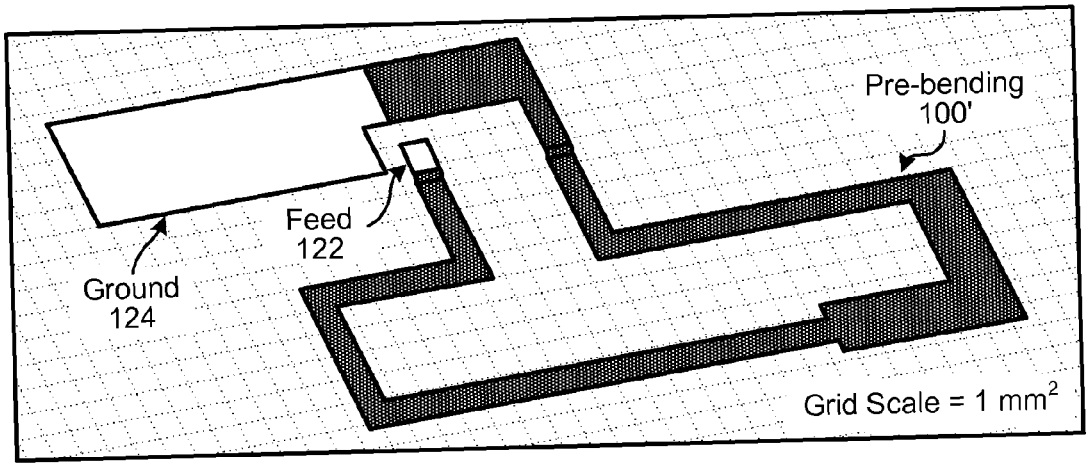
FIGS. 2A to 2C illustrate a scale view of the folded loop-shaped antenna before and after bending from an angle.
Figure 2B:
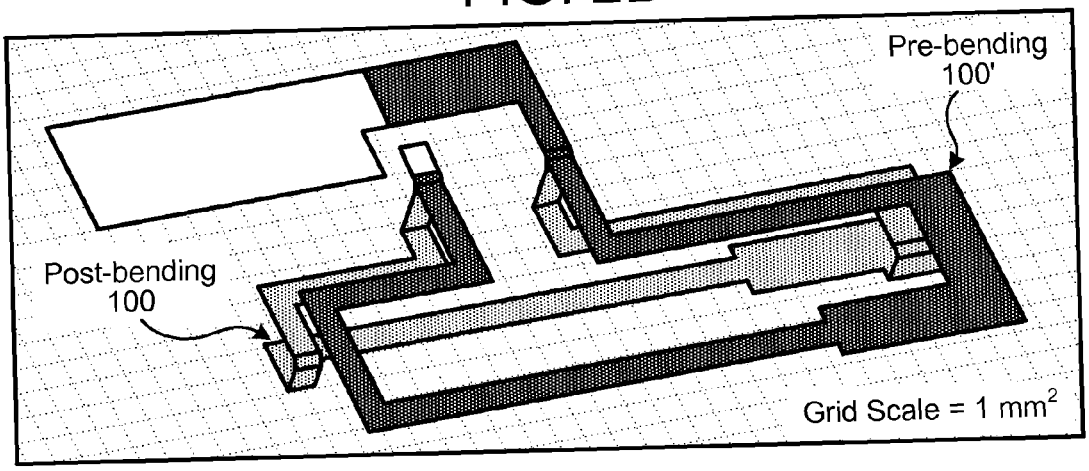
Figure 2C:
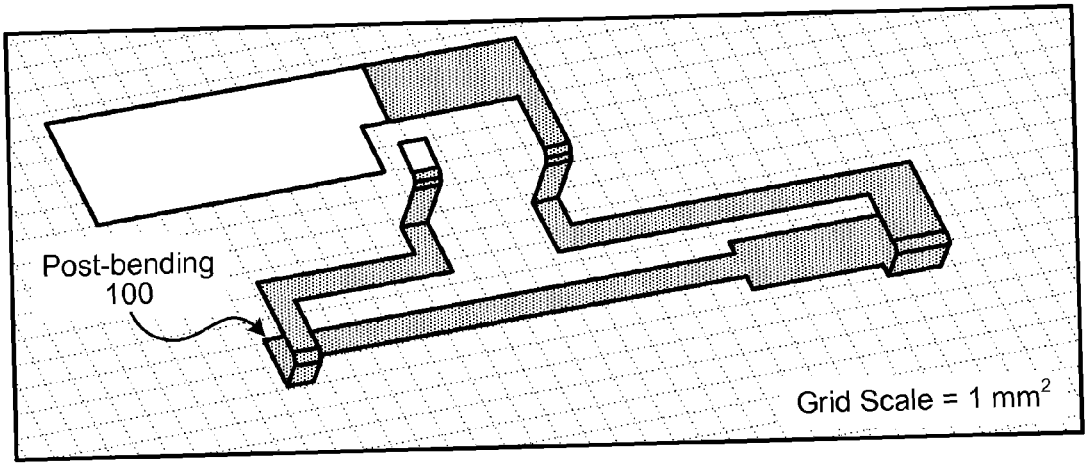

FIG. 1A illustrates an example of a new low SAR folded loop-shaped antenna 100 with a Γ (gamma) shape. (The gamma shape refers to the way the loop is folded, and will be more apparent in FIGS. 11, 15, and 16). As shown, the Γ-shaped antenna is optimized for the 5 GHz band, generating dual resonant elements with two separate SAR hotspots corresponding to high current points of the resonances. FIG. 1B illustrates the same antenna 100' prior to being bent into the Γ shape. The antenna comprises an elongated loop 110 with a first arm 112 and a second arm 114 extending from a gap 116 in the elongated loop. The first arm 112 is connected to a feed terminal 122, and the second arm 114 is connected to a ground plane/terminal 124. The end of the arm 114 connects to the ground plane/terminal 124 proximate to feed terminal 122 (illustrated by a gap 118 between the arm 124 and the feed terminal 122). FIGS. 2A to 2C illustrate the same antenna from a different angle before and after bending. The elongated loop 110 and both arms 112, 114 may contribute to resonance.

Figure 3:
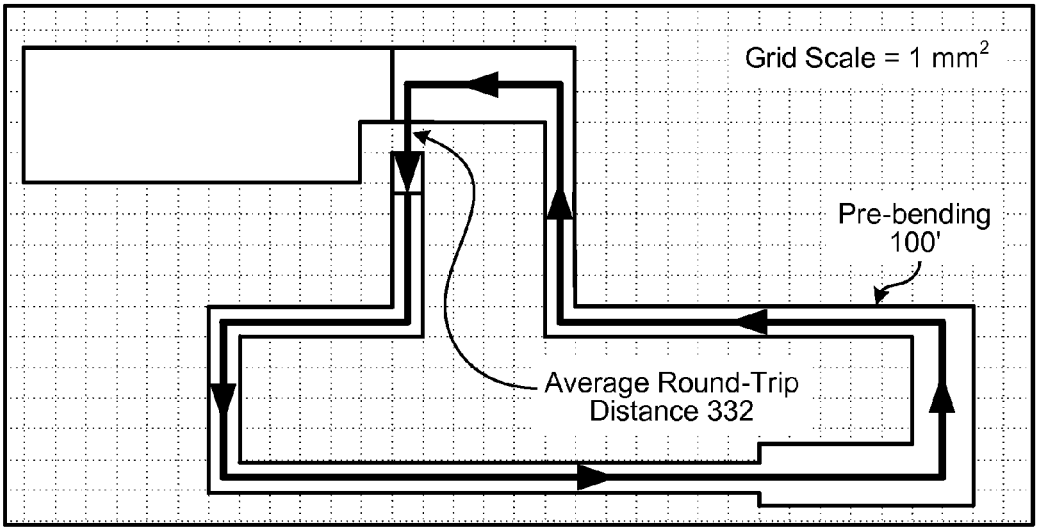
FIGS. 3 and 4 illustrate scale views of the folded loop-shaped antenna demonstrating distances relevant to resonance in the antenna.

A circumference around the elongated loop 110 and both arms 112, 114 may approximately be equal to one-and-a-half wavelengths of an operating frequency ($\sim 1.5\lambda_1$) in the upper targeted emission band (e.g., WiFi 5 GHz band). The distance does not have to be exact, and is affected by dielectric loading of the antenna by adjacent structures when positioned inside an actual device. For example, in FIG. 3, the average circumference 332 around the resonant structure is approximately 72 mm. For comparison, an idealized $1.5\lambda_1$ for a frequency of 5.6 GHz in vacuum is 80.36 mm.

In addition to $1.5\lambda_1$, a circumference around the resonant structure may be approximately equal to one-half wavelengths of an operating frequency ($\sim 0.5\lambda_2$) in the lower targeted emission band (e.g., WiFi 2.4 GHz band). Again, this distance does not need to be exact. For comparison, an idealized $0.5\lambda_2$ for a frequency of 2.44 GHz would be 61.48 mm.

Figure 4:
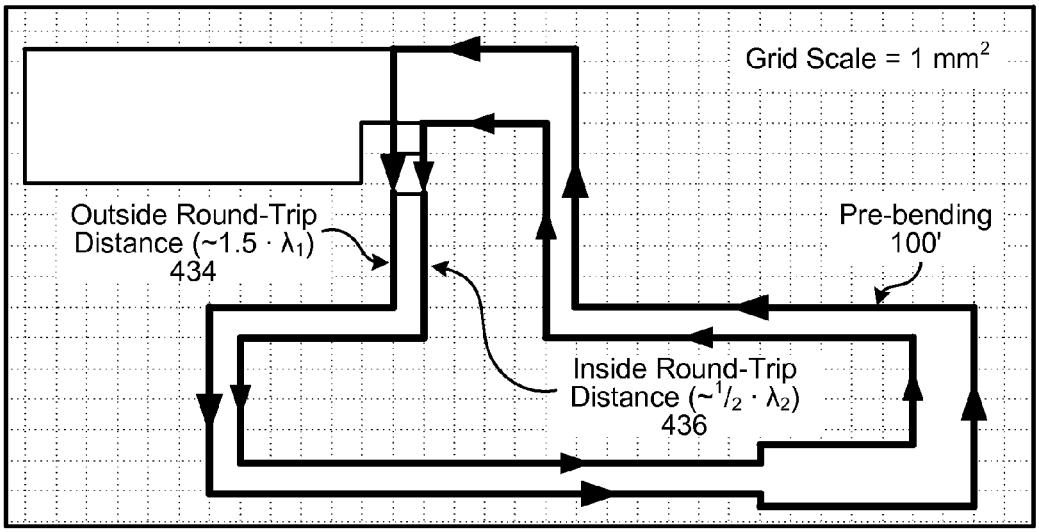

In combination, an average circumference 332 around the resonant structure may be approximately equal to an average of $1.5\lambda_1$ and $0.5\lambda_2$ (i.e., $\sim(1.5\lambda_1+0.5\lambda_2)/2$). Using the idealized wavelengths for 5.6 GHz and 2.44 GHz, the average would be 70.9 mm (whereas the illustrated average circumference is approximately 72 mm). This concept is further illustrated in FIG. 4, highlighting the outer circumference 434 and inner circumference 436 of the resonant structure. As illustrated, the outer circumference 434 is approximately 80 mm (compare with the idealized $1.5\lambda_1$ of 80.36 mm) and the inner circumference 436 is approximately 66 mm (compare with the idealized $0.5\lambda_2$ of 61.48 mm). Thus, in addition to averaging, the respective wavelengths to be used to approximate outer and inner circumferences.

The particular frequencies of 2.44 GHz and 5.6 GHz are used herein as examples for demonstration, as they are toward the middle of the frequency range of their respective bands. However, any frequency or a variety of frequencies within the respective bands might be used when tuning and optimizing the antenna design. As 5 GHz transmissions may require higher power than 2.4 GHz transmissions and an objective may be to spatially separate the dual resonant elements to lower SAR intensity, it may be more important to tune the circumference of the resonant structure for the 5 GHz band than the 2.4 GHz band.

Dual resonant elements are located at two locations in the structure. Referring to the upper frequency band (5 GHz), a first peak of surface current occurs approximately one-quarter wavelength ($\sim 0.25\lambda_1$) from the feed terminal 122, and a second peak of surface current occurs approximately one-half wavelength ($\sim 0.5\lambda_1$) further around the resonant structure from the first peak. This roughly corresponds to the opposite ends of the elongated loop 110 relative to the long axis 120, providing a more uniform emission distribution than the concentrated energy emission of the PIFA.

Figure 5:
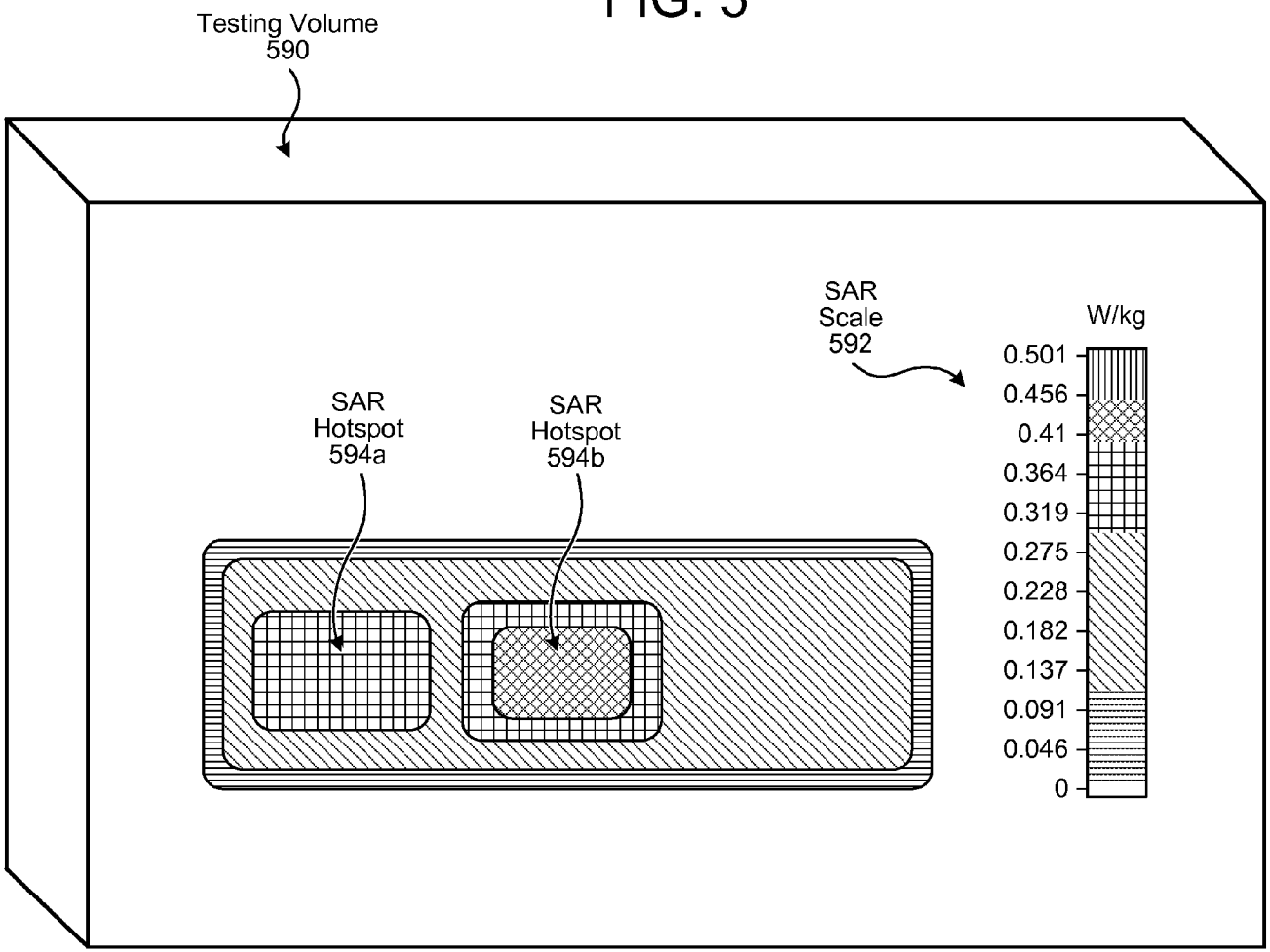
FIG. 5 illustrates the dual SAR hotspots generated by the folded loop-shaped antenna.

FIG. 5 illustrates a SAR testing volume 590 showing the dual SAR hotspots 594*a* and 594*b* resulting from the testing of a device utilizing the loop-shaped antenna 100 at a resonant frequency of 5.6 GHz. A center of each SAR hotspot generally corresponds to a surface current peak of the antenna at the measured frequency. The same feed signal power is used as was used with the PIFA discussed in FIG. 18. Both hotspots 594*a/b* experience a significantly lower SAR than was demonstrated by the PIFA, as illustrated by the reduced scale 592, maxing out at less than one-third of the FCC limit of 1.6 W/kg. This distributed SAR profile affords device designers the flexibility of lower SAR ratings and/or the headroom to increase power levels to a single antenna structure.

Dual hotspots corresponding to the dual resonant elements are positioned across the 5 GHz WiFi band. Depending on which frequency in the 5 GHz band is tested, one hotspot may have a stronger peak SAR value than the other (such as those shown for 5.6 GHz), or the hotspots may have a same profile.

Figure 6:
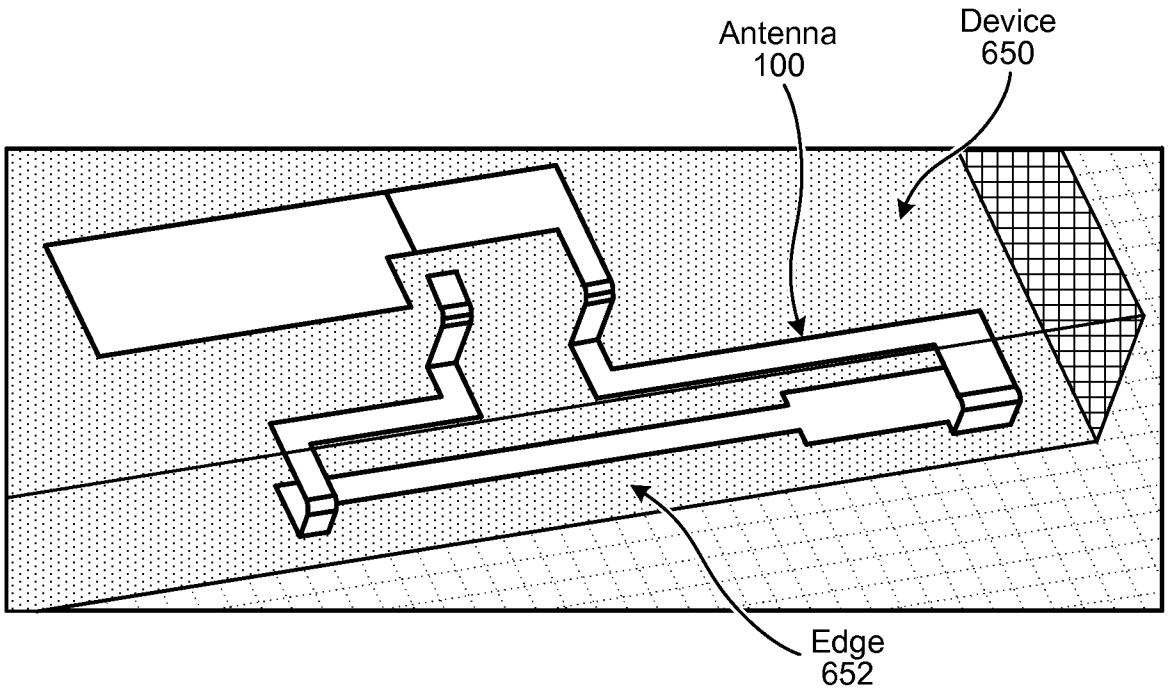
FIG. 6 illustrates the folded loop-shaped antenna inside a device.

FIG. 6 illustrates an example of how the antenna 100 might be positioned in a device 650 near an edge 652. In terms of mechanical construction, the resonant portion of the antenna is not bonded to the surrounding structure, and is free to slide but-for the connection to the bonded terminals 122, 124. Although not illustrated, non-electronic, non-metallic components may be slid into the space between the two sides of the folded elongated loop 110, such that the antenna folds around the components. This space may be 1 mm as illustrated or may have a different size depending on the antenna configuration. Suitable component examples include glass, a non-metal frame, or an unused (cladding-free) edge of a plastic circuit board.

Figure 7:
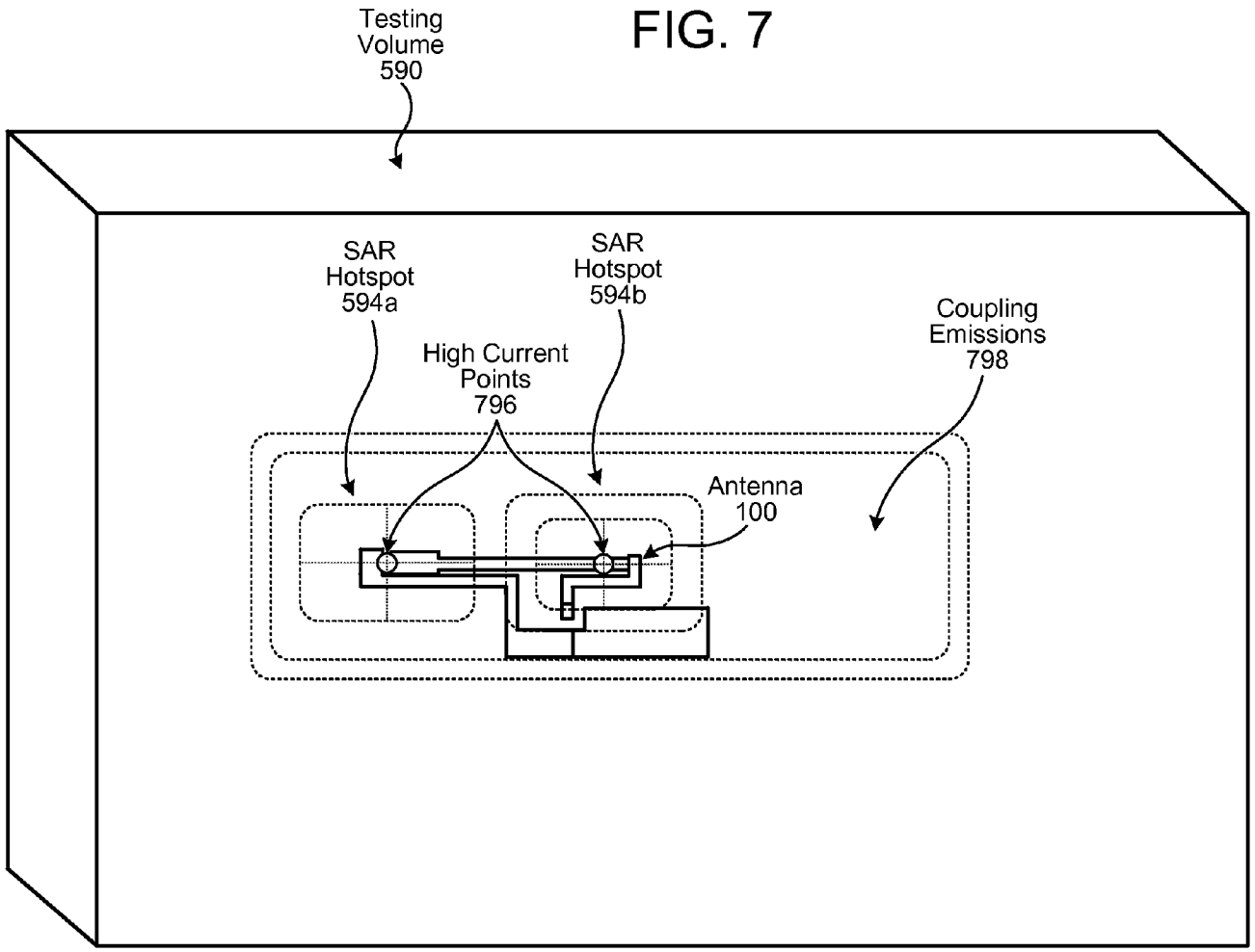
FIG. 7 illustrates the approximate position of the folded loop-shaped antenna relative to the generated SAR hotspots illustrated in FIG. 5.

FIG. 7 illustrates the relative position of the antenna 100 relative to the SAR hotspots 594*a/b*, as well as the approximate position of the high current points 796 at 5.6 GHz. However, the orientation of the testing volume 590 relative to the device 650 shown in FIG. 6 was parallel to the edge 652 (such that the antenna in FIG. 7 should be rotated 90 degrees around the long axis), as that was the surface of the device where emissions in the 5 GHz band were strongest. A similar structural arrangement was used with the PIFA example in FIG. 18.

As shown in FIG. 7, a SAR emission pattern 798 appears beyond the antenna structure. This may occur when the antenna 100 is proximate to a metallic antennae track in a device, resulting in coupling between the antenna 100 and the track, producing resonance in the track. By repositioning the antenna track relative to the antenna 100, this coupling may be reduced or eliminated.

Figure 8A:
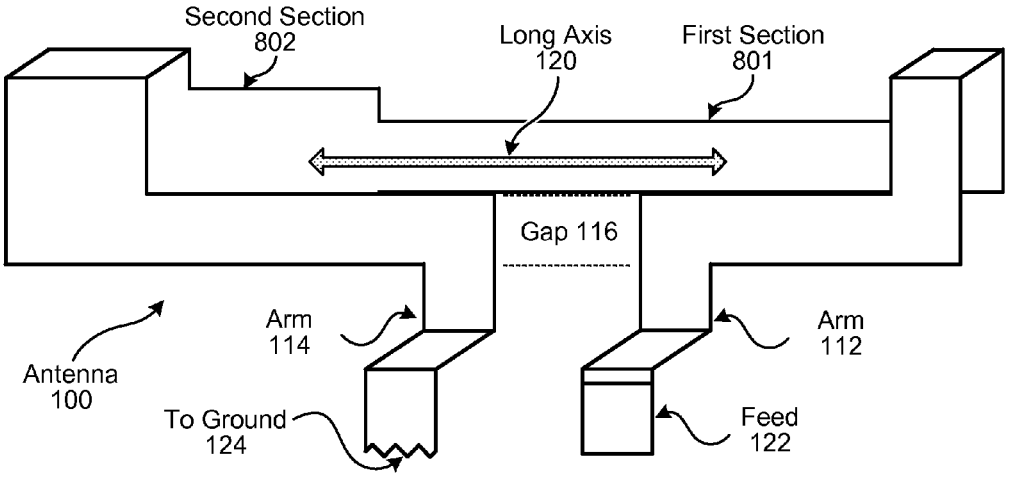
FIGS. 8A to 8C illustrate various dimensions and features of the folded loop-shaped antenna.
Figure 8B:
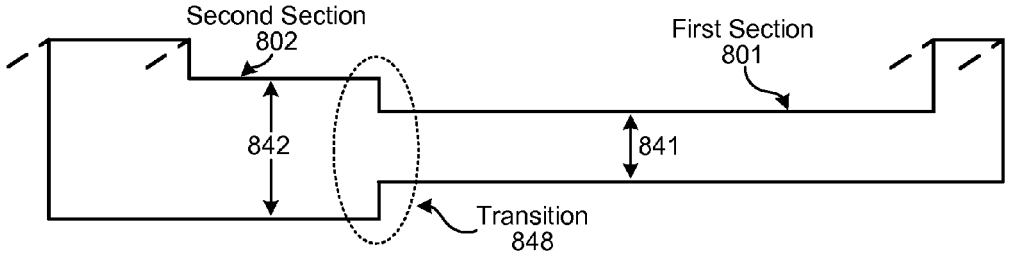
Figure 8C:
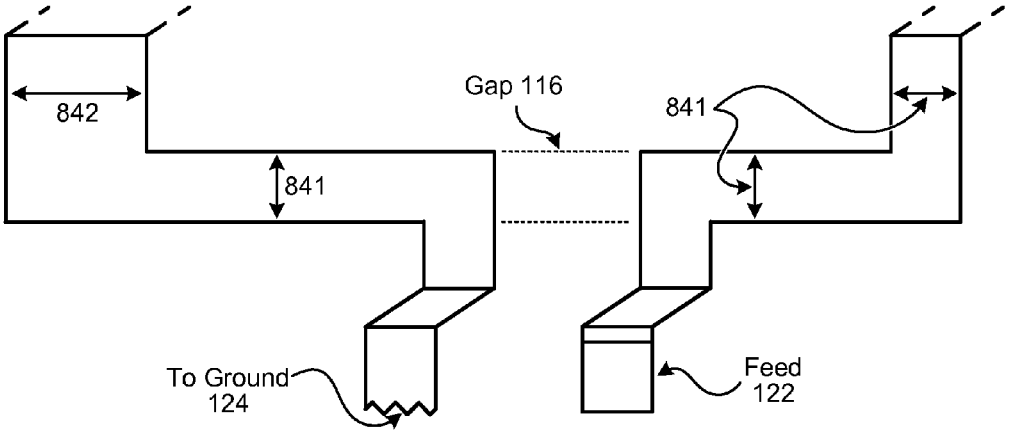

FIGS. 8A to 8C illustrate various features and dimensions of the antenna 100. The side of the elongated loop 110 opposite the side with the gap 116 includes a first section 801 having a first width 841 and a second section 802 having a second width 842. The transition 848 between the first width 841 and the second width 842 may be abrupt and discontinuous, as it serves to reflect signals back toward the ground terminal 124, tuning resonances. Even though the whole antenna may be used to generate resonances in both the 2.4 GHz and 5 GHz bands, if the 5 GHz band is favored when optimizing circumference, operating efficiency may be somewhat reduced in the 2.4 GHz band. By including and positioning the transition 848 at a distance approximately equal to one-quarter of a wavelength of an operating frequency in the lower frequency band (~$0.25\lambda_2$) from an interface of the arm 114 with the ground terminal 124, the efficiency of resonance in the lower frequency band may be improved, providing a boost to emissions in 2.4 GHz band.

Figure 9A:
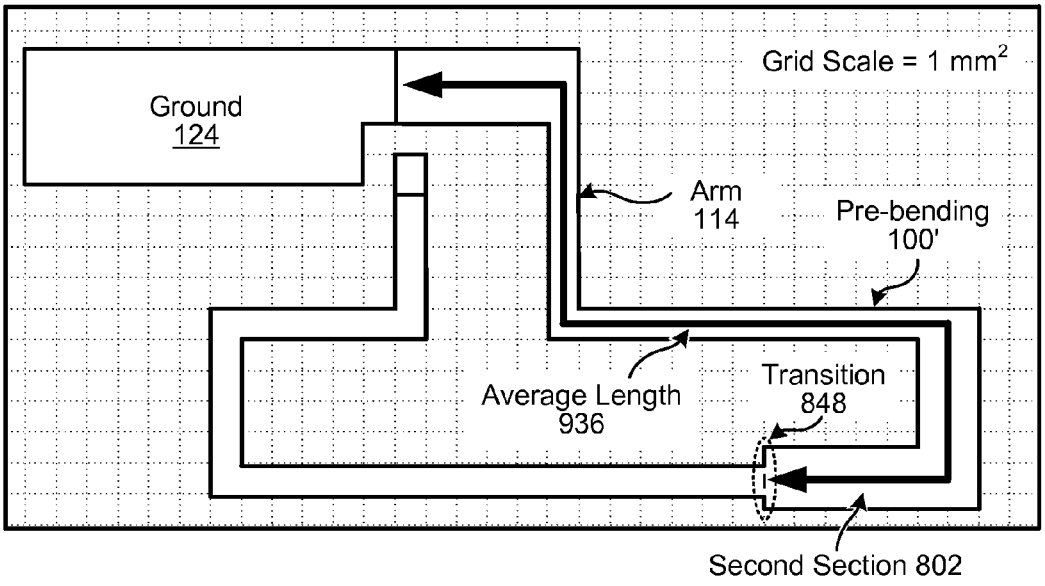
FIGS. 9A and 9B illustrate a scale view of the folded loop-shaped antenna demonstrating a distance relevant to resonances in the antenna.

FIG. 9A illustrates the average length 936 from the transition 848 to the interface of the arm 114 of the resonant structure with the ground terminal 124. As with circumference, the actual distance does not have to be exact and is affected by dielectric loading by adjacent structure when positioned inside an actual device. For example, in FIG. 9A, the average length 936 is approximately 36.5 mm. For comparison, an idealized $0.25\lambda_2$ for a frequency of 2.44 GHz in vacuum is 30.74 mm.

The transition 848 may also tune the positions of the dual resonant elements in the upper targeted emission band (e.g., 5 GHz). This may be done, for example by positioning the transition 848 at a distance approximately equal to three-quarters of a wavelength of a frequency in the upper targeted emission band (~$0.75\lambda_1$) from the interface of the arm 114 with the ground terminal 124. Again, this distance does not need to be exact. For comparison, an idealized $0.75\lambda_1$ for a frequency of 5.6 GHz is 40.18 mm.

Figure 9B:
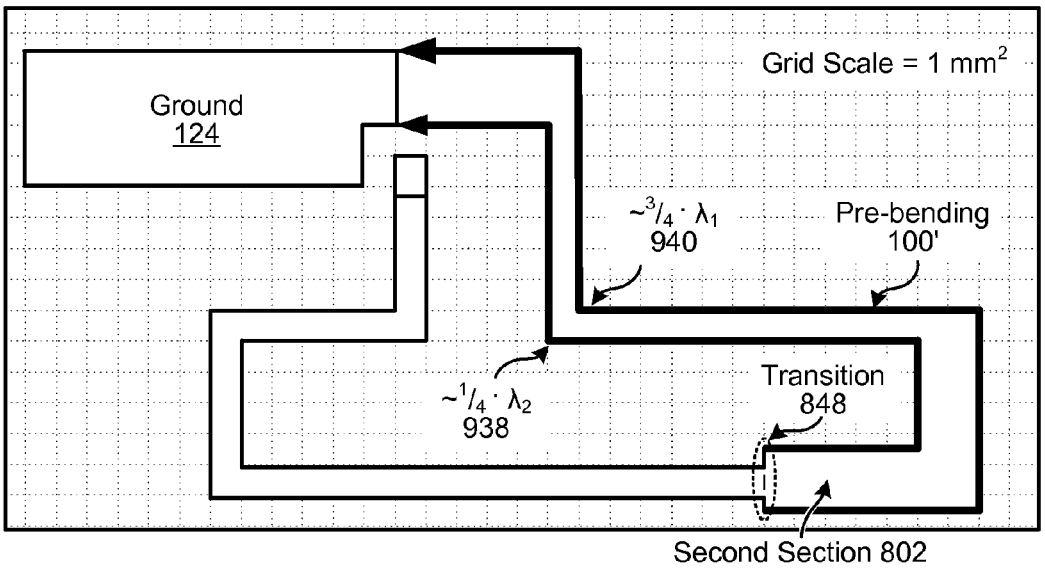

In combination, an average length 336 from the transition 848 to the interface of the arm 114 with the ground terminal 114 may be approximately equal to an average of $0.75\lambda_1$ and $0.25\lambda_2$ (i.e., ~$(0.75\lambda_1+0.25\lambda_2)/2$). Using the idealized wavelengths for 5.6 GHz and 2.44 GHz, the average would be 35.46 mm (whereas the illustrated average length is approximately 36.5 mm). This concept is further illustrated in FIG. 9B, highlighting the inner-edge length 938 and outer-edge length 940 of the resonant structure between the transition 848 and the ground terminal 124. As illustrated, the inner-edge length 938 is approximately 31 mm (compare with the idealized $0.25\lambda_2$ of 30.74 mm) and the outer-edge length 940 is approximately 42 mm (compare with the idealized $0.75\lambda_1$ of 40.18 mm). Thus, in addition to averaging, the respective wavelengths to be used to approximate outer and inner edge lengths.

Figure 10:
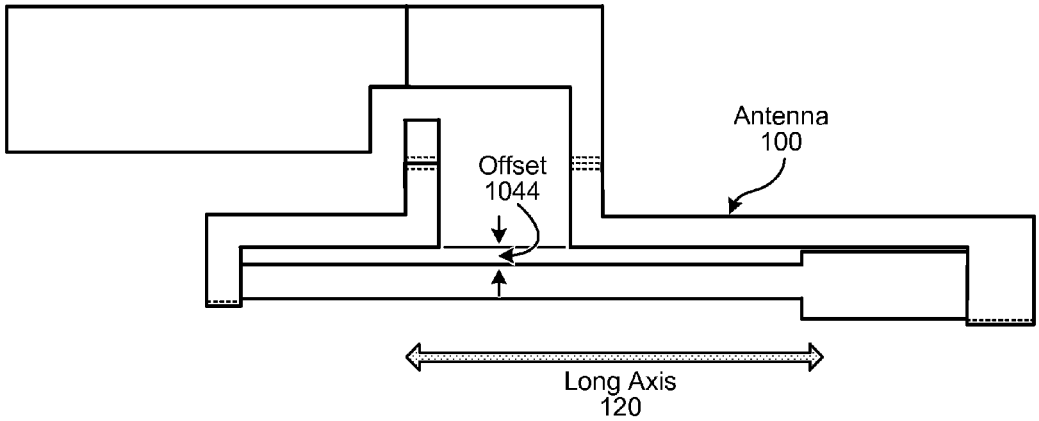
FIG. 10 illustrates an offset between opposite sides of the folded loop-shaped antenna.

FIG. 10 illustrates the small offset 1044 between the two sides of the elongated loop 110. The offset can be thought in terms of an imaginary plane. The plane runs along the inner edge of the elongate loop 110 along the side of the loop with the gap 116, with one dimension parallel to the long axis 120 and the other extending out perpendicular to the adjacent flat surface of the antenna. Stated more generally, as it would apply to any shaped conductor, the plane runs along the inner edge of the loop along the side of the loop with the gap, with one dimension parallel to the long axis and the other dimension perpendicular to 0° relative to the 180° fold in the loop. The distance between this imaginary plane and the other side of the loop impacts high-frequency coupling across the 1 mm space between the two sides of the loop. The more the two approximately-parallel flat surfaces on opposite sides of the loop overlap each other, the greater the high-frequency coupling. Therefore, while the antenna may be functional with overlapping sides, having little or no overlap of the sides across the fold may improve efficiency.

Figure 11:
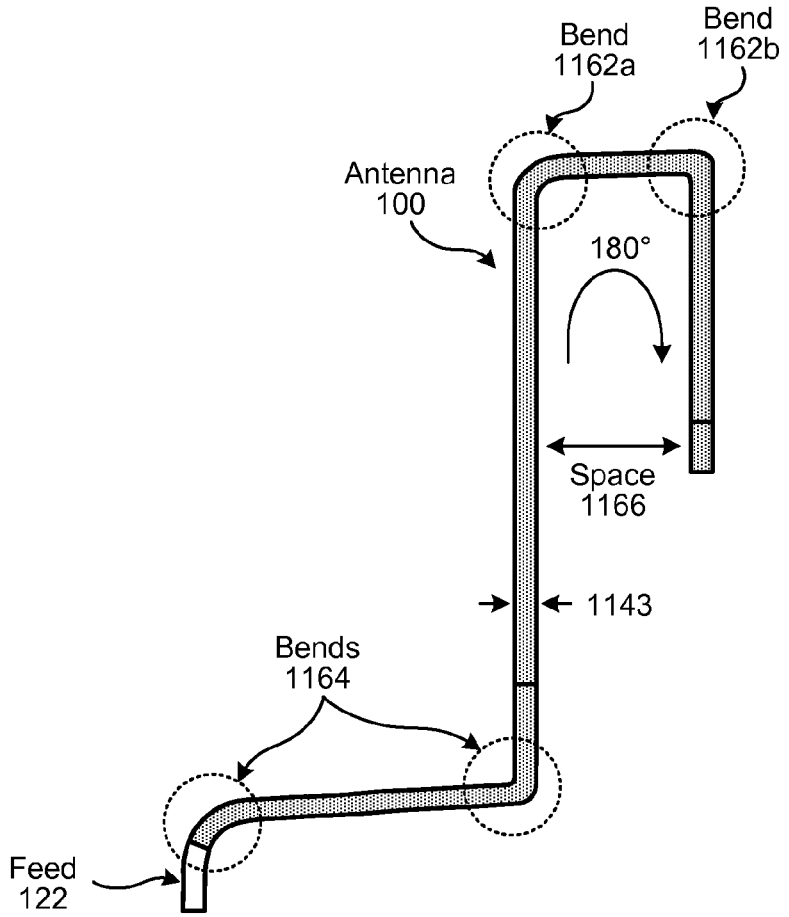
FIG. 11 is a side view of the folded loop-shaped antenna.

FIG. 11 illustrates a side profile of the antenna 100 coupled to the feed terminal 122. The elongated loop 110 is folded around a space 1166, with the space 1166 separating the two sides by approximately 1 mm. The particular angles or curvature used to fold the antenna back one-hundred-eighty degrees may be varied, but as illustrated bends 1162*a* and 1162*b* are slightly greater and slightly less than ninety degrees respectively, giving the antenna its "gamma" shape. The antenna folds back upon itself in a plane orthogonal to the long axis 120, thereby decreasing the relative distance between sides of the loop. The bends 1164 in the arms 112, 114 are due to mechanical constraints within the device 650 and are not directly related to antenna performance. Moving the two sides of the loop further apart (increasing the space 1166 beyond 1 mm) may increase antenna volume, thereby increasing efficiency, but would also move the resonant elements closer together, increasing the overlap between the SAR hotspots.

The antenna 100 may be constructed from a continuous, monolithic flat metal conductor, cut or etched from metal sheeting in the conventional manner. The metal sheeting may be standard sheeting commonly used for existing PIFA antennas, and may have a thickness 1143 of around 10 to 20 microns, although different thickness material may also be used.

Figure 12:
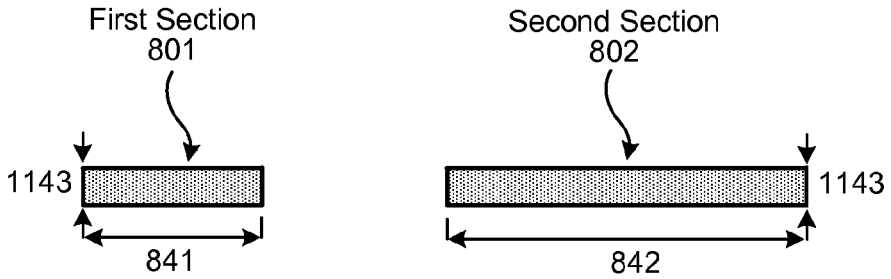
FIG. 12 illustrates cross-sections from the folded loop-shaped antenna.

FIG. 12 illustrates the cross-sectional areas of the first and second sections 801, 802. Among other things, the cross-sectional area impacts the drift velocity (speed) of electrons through the resonator, with the width 841, 842 impacting the formation of resonance modes at the various frequencies. In the example antenna 100, the first width 841 is about 1 mm and the second width 842 is about 2 mm. Increasing widths may widen the range of frequencies available in a particular band, but the creation of additional resonance modes may reduce efficiency.

Figure 13:
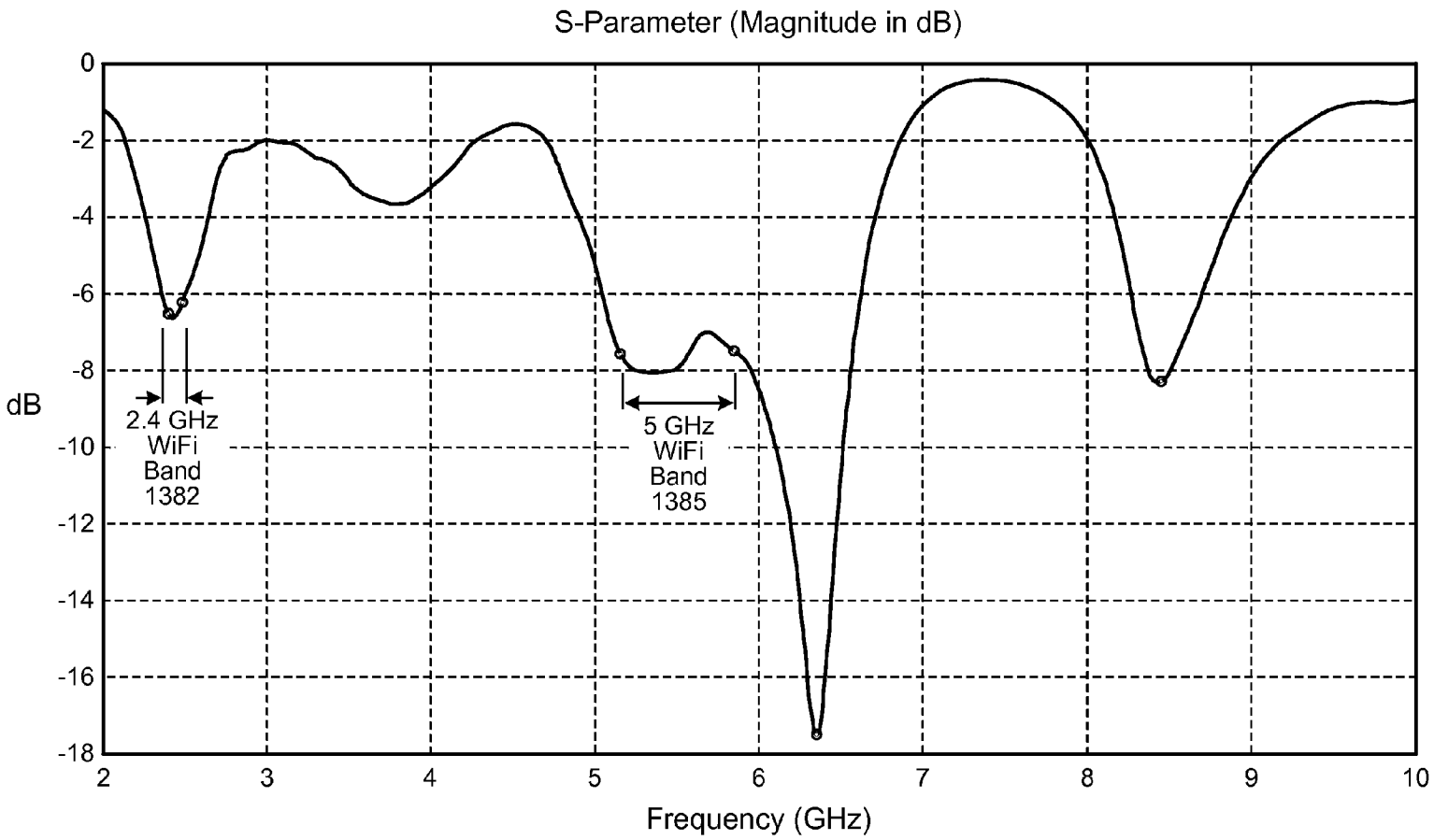
FIG. 13 is a scattering parameter (S-parameter) chart illustrating performance characteristics of the folded loop-shaped antenna.
Figure 14:
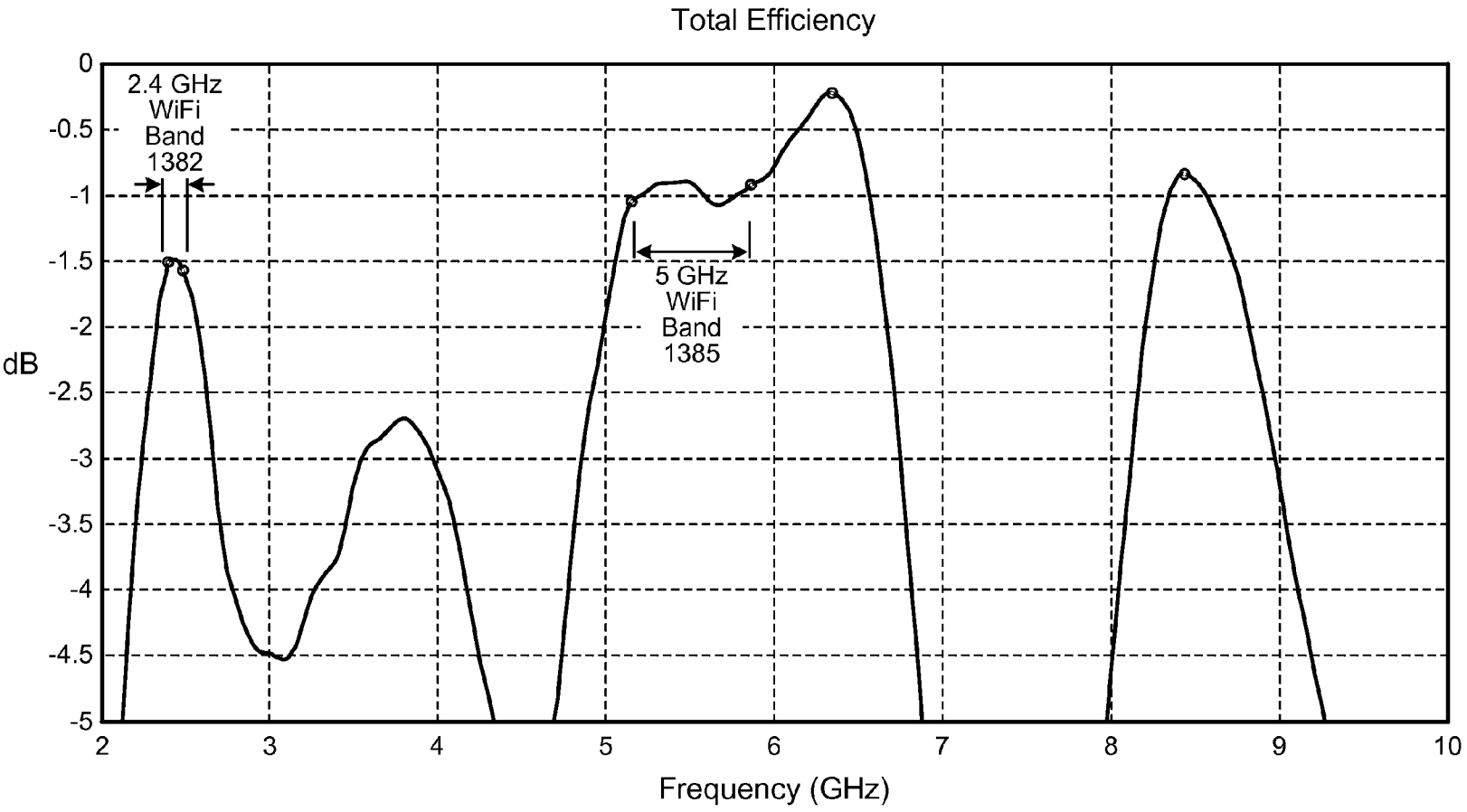
FIG. 14 is a chart illustrating the total efficiency of the folded loop-shaped antenna.

FIG. 13 illustrates a scattering-parameter (S-parameter) chart for the antenna 100, with the troughs demonstrating resonance in the antenna. One trough spans in the 2.4 GHz WiFi band 1382, and another spans the 5 GHz WiFi band 1385. The trough covering the 5 GHz band is particularly wide, which is desired for operation with wide-channel high-speed standards such as 802.11ac. FIG. 14 illustrates total efficiency of the antenna. The dots included on FIG. 13 correspond to the dots at the same frequencies in FIG. 14, and are included to simplify comparison between the two charts.

Figure 15:
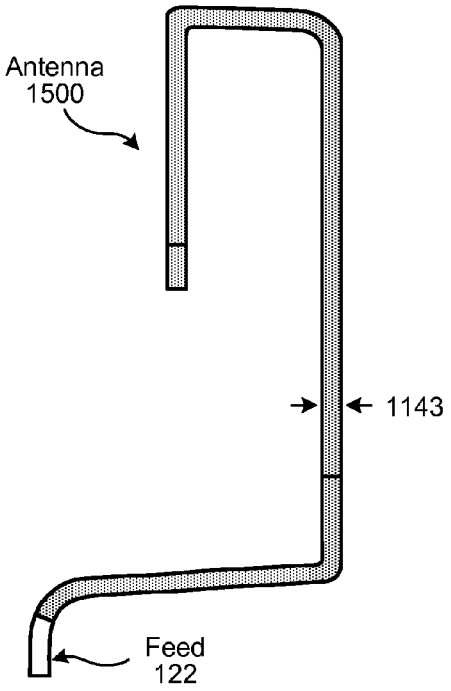
FIGS. 15 and 16 illustrate the folded loop-shaped antenna with differently bent feed arms.
Figure 16:
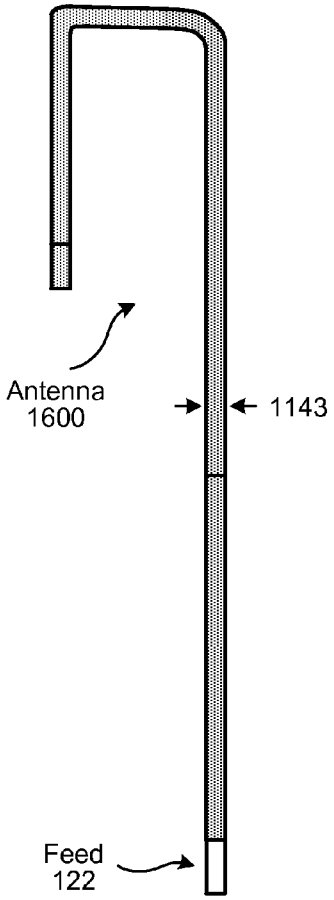

FIGS. 15 and 16 illustrate the structure of the antenna with different bends to illustrate that the gamma-folded antenna structure may be used in different configurations with differing mechanical/space considerations. Both antennae 1500 and 1600 are formed from the same pre-bending structure 100' and are interchangeable with antenna 100. Antenna 1500 may experience somewhat diminished performance due to the decreased volume occupied by the antenna, whereas the loop 110 in antenna 1600 will be farther away from the antennae track, reducing unwanted resonance in the track and potentially increasing performance.

Figure 17:
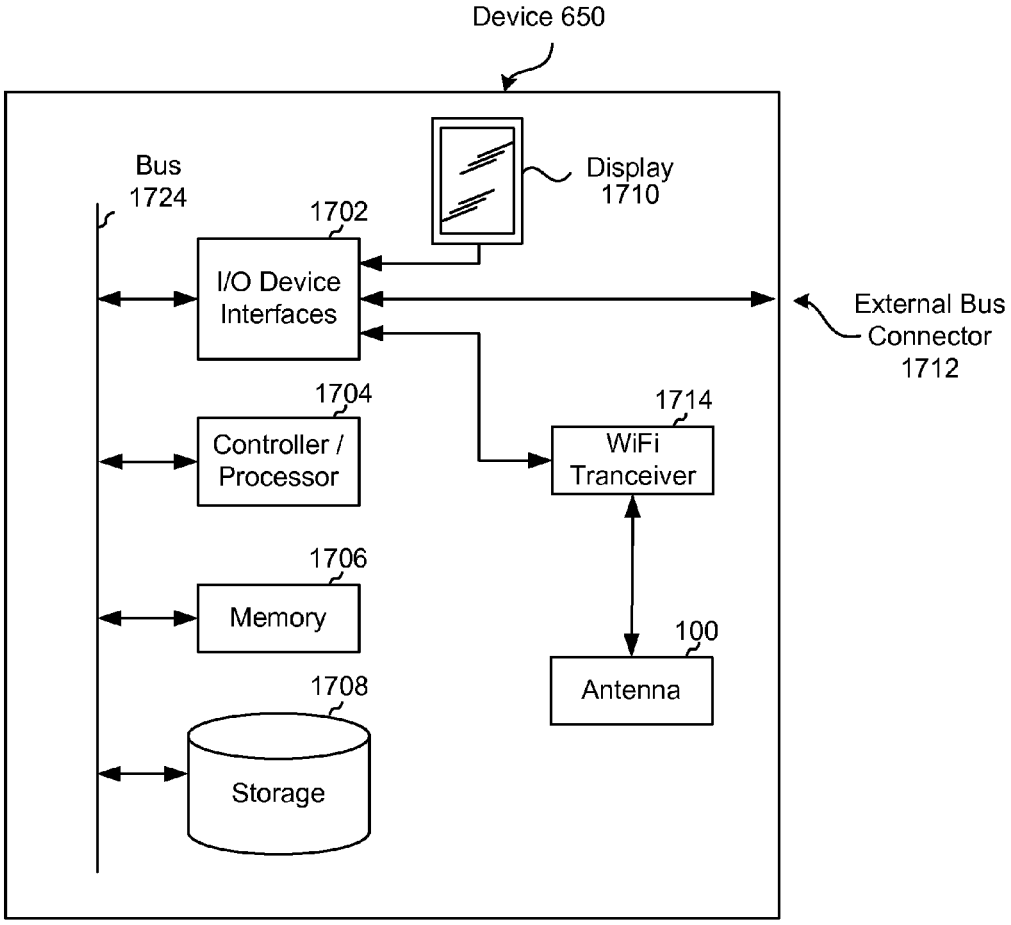
FIG. 17 is a block diagram conceptually illustrating a device including the folded loop-shaped antenna.

FIG. 17 is a block diagram of an example device 650 that includes the antenna 100. The device 650 includes one or more controllers or processors 1704 connected via one or more busses 1724 to a memory 1706 (e.g., random access memory) and storage 1708 (e.g., non-volatile bulk-storage such as Flash memory). The controller/processor 1704 is also connected via bus 1724 to an input/output device interface 1702 which serves as a bridge to various other components, such as a display 1710, an external bus connector 1712 (e.g., USB), and a WiFi transceiver 1714. The WiFi transceiver 1714 may support communications in multiple bands, such as the 2.4 GHz and 5 GHz WiFi bands, and may support multiple standards, such as IEEE 802.11b, g, n and ac. The WiFi transceiver is connected to the feed terminal 122 of the antenna 100, as well as to the ground plane connected to the ground terminal 124.

Although the disclosed design is optimized for operation in the 2.4 GHz and 5 GHz WLAN bands, as well as the overlapping Industrial, Scientific and Medical (ISM) radio bands (2.400-2.4835 GHz and 5.725-5.875 GHz), the design principles are not so limited and may be applied to other frequency combinations. In addition, the design may be optimized to operate in bands adjacent to the WLAN and ISM bands, such as the 2.3 GHz bands (2305-2320 MHz and 2345-2360 MHz) and 2.5 GHz bands (2500-2690 MHz) used by wireless Metropolitan Area Network standards such as IEEE 802.16 (e.g., WiMAX).

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art.

As used in this disclosure, the term "a" or "one" may include one or more items unless specifically stated otherwise.

What is claimed is:

1. An antenna comprising:

a monolithic flat metal conductor forming a first arm, an elongated loop including a gap, and a second arm, the first arm and second arm extending from endpoints of the elongated loop on opposite sides of the gap, the first arm connecting the elongated loop to a feed terminal and the second arm connecting the elongated loop to a ground terminal, an interface of the second arm with the ground terminal being proximate to the feed terminal, wherein:

the elongated loop has substantially straight first and second sides oriented in a direction of a long axis of the elongated loop, the gap being on the first side of the loop, wherein the elongated loop folds back upon itself approximately 180° along the long axis of the elongated loop with the first and second sides being on opposite sides of a fold, the second side of the elongated loop has a first section with a smaller cross-sectional area than a second section, a transition in cross-sectional areas between the first and second sections being discontinuous, the first section being on a feed terminal side of the transition and the second section being on a ground terminal side of the transition, and a first distance from an interface of the first arm with the feed terminal, along the conductor forming the first arm, the elongated loop, and the second arm, back to the interface of the first arm with the feed terminal, is approximately equal to one-and-one-half of a wavelength corresponding to an operating frequency in a 5 GHz Wireless Local Area Network (WLAN) band.

2. The antenna of claim 1, wherein a second distance from the interface of the first arm with the feed terminal, along the conductor forming the first arm, the elongated loop, and the second arm, back to the interface of the first arm with the feed terminal, is approximately equal to one-half of a wavelength corresponding to an operating frequency in a 2.4 GHz WLAN band.

3. The antenna of claim 1, wherein a width of the flat conductor composing the first section is approximately 1 mm and a width of the flat conductor composing the second section is approximately 2 mm.

4. A wireless communication device comprising:

a processor communicatively coupled to a radio transceiver;

the radio transceiver, configured to operate in a 5 GHz frequency band in accordance with a first Wireless Local Area Network (WLAN) protocol; and an antenna comprising a monolithic conductor forming an elongated loop including a gap, the radio transceiver being electrically connected to a feed terminal of the antenna, the monolithic conductor of the antenna further forming a first arm and a second arm, the first arm and second arm extending from endpoints of the elongated loop on opposite sides of the gap, the first arm connecting the elongated loop to the feed terminal, and the second arm connecting the elongated loop to a ground terminal, an interface of the second arm with the ground terminal being proximate to the feed terminal, wherein:

the elongated loop is elongated relative to a long axis, the elongated loop folds back upon itself approximately 180° in a plane orthogonal to the long axis, a first distance around the antenna, from an interface of the first arm with the feed terminal, along the conductor forming the first arm, the elongated loop, and the second arm, back to the interface of the first arm with the feed terminal, is approximately equal to one-and-one-half of a wavelength of an operating frequency in the 5 GHz frequency band, a first side and a second side of the elongated loop are offset from each other, characterized by the first side including the gap and the second side being opposite the first side, an outer edge of the second side being offset from an inner edge of the first side so that the first and second sides do not overlap across the approximately 180° fold of the elongated loop.

5. The wireless communication device of claim 4, wherein the first side and the second side are substantially straight and oriented in a direction of the long axis of the elongated loop.

6. A wireless communication device comprising:

a processor communicatively coupled to a radio transceiver;

the radio transceiver, configured to operate in a 5 GHz frequency band in accordance with a first Wireless Local Area Network (WLAN) protocol; and an antenna comprising a monolithic conductor forming an elongated loop including a gap, the radio transceiver being electrically connected to a feed terminal of the antenna, the monolithic conductor of the antenna further forming a first arm and a second arm, the first arm and second arm extending from endpoints of the elongated loop on opposite sides of the gap, the first arm connecting the elongated loop to the feed terminal, and the second arm connecting the elongated loop to a ground terminal, an interface of the second arm with the ground terminal being proximate to the feed terminal, wherein:

the elongated loop is elongated relative to a long axis, the elongated loop folds back upon itself approximately 180° in a plane orthogonal to the long axis, a first distance around the antenna, from an interface of the first arm with the feed terminal, along the conductor forming the first arm, the elongated loop, and the second arm, back to the interface of the first arm with the feed terminal, is approximately equal to one-and-one-half of a wavelength of an operating frequency in the 5 GHz frequency band, a second distance from the interface of the first arm with the feed terminal, along the conductor forming the first arm, the elongated loop, and the second arm, back to the interface of the first arm with the feed terminal is approximately equal to one-half of a wavelength of an operating frequency in a 2.4 GHz band, the radio transceiver further being configured to operate in the 2.4 GHz frequency band in accordance with a second WLAN protocol, the elongated loop includes a first section with a smaller cross-sectional area than a second section, a transition in cross-sectional area between the first and second sections being discontinuous, the first section being on a feed terminal side of the transition and the second section being on a ground terminal side of the transition, and a third distance along the conductor from the transition to the interface of the second arm with the ground terminal is approximately equal to one-quarter of the wavelength of the operating frequency in the 2.4 GHz band.

7. The wireless communication device of claim 6, wherein a fourth distance along the conductor from the transition to the interface of the second arm with the ground terminal is approximately equal to three-quarters of the wavelength of the operating frequency in the 5 GHz band.

8. The wireless communication device of claim 7, wherein the first section, the second section, and the transition are on a side of the elongated loop opposite the gap, the side being substantially straight and oriented in a direction of the long axis of the elongated loop.

9. An antenna structure comprising:

a conductor forming a first terminal, a first arm, an elongated loop including a gap, a second arm, and a second terminal, with the first arm and second arm extending from endpoints of the elongated loop on opposite sides of the gap, the first arm connecting the elongated loop to the first terminal, and the second arm connecting the elongated loop to the second terminal, an interface of the second arm with the second terminal being proximate to the first terminal, wherein:

the elongated is elongated relative to a long axis, the elongated loop folds back upon itself approximately 180° in a plane orthogonal to the long axis, a first distance from an interface of the first arm with the first terminal, along the conductor forming the first arm, the elongated loop, and the second arm, back to the interface of the first arm with the first terminal is approximately equal to one-and-one half of a wavelength of an operating frequency between 5.1 GHz and 5.875 GHz, and the elongated loop includes a first section having a first cross-sectional width and a second section having a second cross-sectional width that is wider than the first width, a transition from the first width to the second width being discontinuous, the first section being on a first terminal side of the transition and the second section being on a second terminal side of the transition, a second distance along the conductor from the transition to the interface of the second terminal with the second arm being approximately equal to one-quarter of a wavelength of an operating frequency between 2.40 GHz and 2.4835 GHz.

10. The antenna structure of claim 9, wherein a third distance from the interface of the first arm with the first terminal, along the conductor forming the first arm, the elongated loop, and the second arm, back to the interface of the first arm with the first terminal, is approximately equal to one-half of a wavelength of an operating frequency between 2.40 GHz and 2.4835 GHz.

11. The antenna structure of claim 9, wherein a third distance along the conductor from the transition to the interface of the second arm with the second terminal is approximately equal to three-quarters of the wavelength of the operating frequency between 5.1 GHz and 5.875 GHz.

12. The antenna structure of claim 9, wherein the first section, the second section and the transition are on a side of the elongated loop opposite the gap, the side being substantially straight and oriented in a direction of the long axis of the elongated loop.

13. The antenna structure of claim 9, wherein the first terminal is a feed terminal and the second terminal is a ground terminal.

14. An antenna structure comprising:

a conductor forming a first terminal, a first arm, an elongated loop including a gap, a second arm, and a second terminal, with the first arm and second arm extending from endpoints of the elongated loop on opposite sides of the gap, the first arm connecting the elongated loop to the first terminal, and the second arm connecting the elongated loop to the second terminal, an interface of the second arm with the second terminal being proximate to the first terminal, wherein:

the elongated is elongated relative to a long axis, the elongated loop folds back upon itself approximately 180° in a plane orthogonal to the long axis, and a first side and a second side of the elongated loop are offset from each other, characterized by the first side including the gap and the second side being opposite the first side, an outer edge of the second side being offset from an inner edge of the first side so that the first and second side do not overlap across the approximately 180° fold of the elongated loop.

15. The antenna structure of claim 14, wherein the first side and the second side are substantially straight and oriented in a direction of the long axis of the elongated loop.

* * * * *